US008844436B2

(12) United States Patent
Frenken

(10) Patent No.: US 8,844,436 B2
(45) Date of Patent: Sep. 30, 2014

(54) HYDRAULIC PRESS UNIT

(75) Inventor: Egbert Frenken, Heinsberg (DE)

(73) Assignee: Textron Innovations, Inc., Providence, RI (US)

( * ) Notice: Subject to any disclaimer, the term of this patent is extended or adjusted under 35 U.S.C. 154(b) by 402 days.

(21) Appl. No.: 13/381,159

(22) PCT Filed: Jul. 1, 2010

(86) PCT No.: PCT/EP2010/059356
§ 371 (c)(1),
(2), (4) Date: Mar. 6, 2012

(87) PCT Pub. No.: WO2011/000907
PCT Pub. Date: Jan. 6, 2011

(65) Prior Publication Data

US 2012/0160065 A1 Jun. 28, 2012

(30) Foreign Application Priority Data

Jul. 2, 2009 (DE) ..... 10 2009 031 678
Jul. 29, 2009 (DE) ..... 10 2009 026 273

(51) Int. Cl.
*B30B 1/32* (2006.01)
*B25F 5/00* (2006.01)

(Continued)

(52) U.S. Cl.
CPC ..... *B25B 27/10* (2013.01); *B21D 39/048* (2013.01); *B21J 15/20* (2013.01); *B25F 5/005* (2013.01); *B21D 22/02* (2013.01)
USPC ..... 100/269.01

(58) Field of Classification Search
CPC ..... B21D 41/02; B21D 22/02; B21D 39/048; B21D 39/04; B21D 28/00; B25F 5/005; B21J 15/20; B21J 15/26; B25B 27/10
USPC ..... 100/50, 269.01, 269.15, 269.16, 100/269.18, 269.19; 72/453.01, 453.14, 72/453.15, 453.16, 453.17, 453.18, 72/453.19, 466.8; 29/525.06
See application file for complete search history.

(56) References Cited

U.S. PATENT DOCUMENTS 3,884,262 A * 5/1975 Assembergs ..... 137/489
4,226,110 A * 10/1980 Suganuma ..... 72/416

(Continued)

FOREIGN PATENT DOCUMENTS

DE 100 64 244 7/2002
DE 101 23 642 11/2002
DE 20 2004 000215 4/2004

OTHER PUBLICATIONS

International Search Report and the Written Opinion of the International Search Report for PCT/EP2010/059356 completed by the European Patent Office on Aug. 3, 2010 (17 pages).

*Primary Examiner* — Jimmy T Nguyen
(74) *Attorney, Agent, or Firm* — Klintworth & Rozenblat IP LLC

(57) ABSTRACT

A hydraulic press unit has a fixed part and a movable part. The movable part is moved relative to the fixed part by a hydraulic piston and is moved back into a starting position by a return spring. In addition, the return motion is actuatable as a function of a predetermined applied pressure by activation of a return valve. A control valve is provided which, in addition to the return valve, opens a hydraulic-medium outlet when in its open state and has a hydraulic-medium inflow side and a hydraulic-medium outflow side. In order to configure the hydraulic press unit, when the return valve opens, the control valve is acted on by the pressure of the returning hydraulic medium on the inflow and outflow sides, the pressure being lower on the inflow side due to throttling.

10 Claims, 6 Drawing Sheets

(51) Int. Cl.

| | |
|---|---|
| ***B21D 39/04*** | (2006.01) |
| ***B21J 15/20*** | (2006.01) |
| ***B21D 22/02*** | (2006.01) |
| ***B25B 27/10*** | (2006.01) |

(56) References Cited

U.S. PATENT DOCUMENTS

| | | | | | |
|---|---|---|---|---|---|
| 5,195,354 | A | * | 3/1993 | Yasui et al. | 72/453.03 |
| 5,282,378 | A | * | 2/1994 | Kimura | 72/453.15 |
| 5,425,164 | A | * | 6/1995 | El Dessouky | 29/243.524 |
| 6,065,326 | A | | 5/2000 | Frenken | |
| 6,164,731 | A | * | 12/2000 | Nakazawa et al. | 303/116.1 |
| 6,276,186 | B1 | | 8/2001 | Frenken | |
| 6,862,793 | B2 | | 3/2005 | Frenken | |
| 7,065,995 | B2 | | 6/2006 | Frenken | |
| 7,908,963 | B2 | | 3/2011 | Frenken | |

* cited by examiner

HYDRAULIC PRESS UNIT

This application is a 35 U.S.C. §371 of PCT/EP2010/059356 which has an international filing date of Jul. 1, 2010. This application claims priority to German application No. 102009031678.7 filed on Jul. 2, 2009 and German application No. 102009026273.3 filed on Jul. 29, 2009. Each of these prior applications are incorporated by reference in their entirety.

FIELD OF THE INVENTION

The invention relates to a hydraulic press unit having a fixed part and a movable part, the movable part being moved relative to the fixed part by means of a hydraulic piston and being movable back into a starting position by a return spring, and in addition the return motion being actuatable as a function of a predetermined applied pressure by activation of a return valve, and furthermore a control valve being provided which, in addition to the return valve, opens a hydraulic-medium outlet when in its open state and has a hydraulic-medium inflow side and a hydraulic-medium outflow side.

BACKGROUND OF THE INVENTION

Existing hydraulic tools, such as hydraulic wrenches, generate heat as result of the use of high temperature hydraulic fluid passing through the tool. The user grips a grip which surrounds a metal valve body through which the high temperature hydraulic fluid passes. It is desirable to prevent the transfer of this heat to the user's hand. The prior art insulates the metal valve body with a PVC-based dip, which tends to be inadequate to prevent the passage of heat generated by the high temperature hydraulic fluid. In addition, the PVC-based dip is not very durable and is not easy to replace if the tool becomes damaged.

Such press units are known in various embodiments. Reference is made to WO 99/19947, for example, as well as WO 98/24570, relating to use as a punching device, WO 02/62504, relating to use as a sizing tool, and WO 02/00368, relating to use as a riveting device.

A press unit of this kind is also known from DE 20 2004 000 215 U1, for example. As a result of a design of the control valve as a check valve, the hydraulic medium which is delivered by the pump passes through the control valve from the inflow side to the outflow side, the control valve being situated in a hydraulic line leading from the hydraulic-medium pump to the hydraulic cylinder which accommodates the hydraulic piston. When the hydraulic-medium pump is switched off, the hydraulic-medium pressure which is present on the outflow side together with a biasing spring which acts in the same direction causes the control valve to move into the open position, thus opening the hydraulic-medium outlet associated with the outflow side. Since in addition the control valve does not open at a higher system pressure, the control valve still does not open at the start of the return flow of hydraulic medium, when the return valve has opened after completion of a pressing operation.

SUMMARY OF THE INVENTION

Based on the prior art described above, it is, according to one aspect, an object of the invention to configure a hydraulic press unit of this kind advantageously with regard to the operation of the control valve. Another aspect concerns an advantageous arrangement of the control valve.

According to a first concept of the invention, when the return valve is open, the control valve is acted on by the pressure of the returning hydraulic medium on the inflow side and on the outflow side, the pressure being lower on the inflow side due to throttling. When the return valve is open, the control valve is accordingly exposed on both sides to the pressure of the hydraulic medium in the return flow region, although at different levels of pressure. The pressure difference resulting from the throttling acts in the opening direction of the control valve, and therefore causes, or at least supports, a rapid opening. This effect may be additionally assisted by means of a spring biasing of the control valve into the open position. On the other hand, in preferred embodiments of the subject matter of the invention, this is not the above-mentioned design criterion for an optionally-selected spring biasing. After the return valve opens, this results, practically immediately or possibly even at the same time as the opening of the return valve, in opening of the control valve, and thus in two outflow possibilities for the hydraulic medium. Thus, a desired quicker return travel of the hydraulic piston may clearly be achieved. On the other hand, there are also applications in which the setting is made in such a way that only a very small quantity of the hydraulic medium flows back through the return valve.

A possible approach, according to which a hydraulic pump is provided, from which a (first) hydraulic-medium flow path leads to the control valve, and a further (second) hydraulic-medium flow path leads directly to the return valve. The hydraulic-medium feed line leading from the hydraulic-medium pump to the control valve and preferably also to a hydraulic cylinder which accommodates the return piston, is also provided directly from the hydraulic-medium pump to the control valve. The mentioned hydraulic-medium flow paths may also partially coincide. It is important that due to the direct connection, the hydraulic medium flows through the feed line to the control valve and to the return valve without first—for example, with reference to the return valve—flowing via the control valve. With regard to the two valves, this provides a parallel connection, starting from the hydraulic-medium pump. The hydraulic-medium inlet (from the pump) and the hydraulic-medium outlet through the (open) return valve are hydraulically located on the same side of the control valve. The connection to the cylinder chamber (movable part) is hydraulically located on the other side of the control valve (or in the bypass for the control valve). Viewed from the movable part, the return valve may be hydraulically situated downstream from the control valve, or, at least additionally, in parallel connection with the control valve. The compact arrangement of the mentioned valves and the hydraulic lines which is thereby made possible is an important aspect.

The spring which biases the control valve into the open position may be formed to have a comparatively small spring force. Thus, even when the pump stops in the course of initiating the pressing operation or during a pressing operation that is already underway, the control valve does not open. Rather, the control valve moves only into its open position when, as the result of the return valve being open, the control valve is additionally acted on by negative pressure, or is acted on due to a pressure difference. For a manual hydraulic press unit, which is preferably in question here, the pressing is usually achieved by a manually-activated triggering of the pump, this being preferably driven by an electric motor. When a respective switch ceases to be pressed down, the pump also stops running. Pressing jaws of a press unit remain stopped in a specific position. In the embodiment described here, the pressing operation may be continued simply by resuming the activation. The hydraulic piston does not return, even if the system pressure or (positive) pressure level in the hydraulic cylinder is still very low at the start of a pressing operation.

The term "control valve" has been chosen to make a clear conceptual distinction. This valve may also be referred to as a further return valve, for example.

Further features of the invention are described below, also in the description of the figures, often in their preferred association with the claim concept discussed above. However, the features may also be important in an association with only one or more features of this claim, or independently of same, or in some other overall concept.

First of all, it is further preferred that the control valve is designed as a seat valve. The valve closes the hydraulic-medium outlet by moving against a seat stop. The opening which is closed by the seat valve extends, relative to an axis of the opening, in the displacement direction of the control valve. No pushing-off occurs; rather, an outflow opening is closed, the opening surface of which is aligned with the control valve relative to a projection in the direction of movement of the control valve.

Related to this, even if not necessarily connected thereto, is the fact that the closed control valve is acted on by a differential force that is formed by the pressure in the hydraulic-medium storage space and the pressure in the hydraulic-medium feed line. Since the pressure in the hydraulic-medium feed line is higher than the pressure in the hydraulic-medium storage space in almost all operating states, this results in a holding force on the control valve when it is in its closed position. Even if a higher pressure is initially necessary to displace the control valve into the closed position, a lower pressure in the hydraulic-medium feed line is sufficient when the control valve is in the closed position, as long as this pressure is still sufficiently higher than the pressure in the hydraulic-medium storage space. The pressure in the hydraulic-medium storage space may correspond to or even be lower than the ambient pressure, i.e., it may be a negative pressure. The latter applies in particular when the pump operates at a high delivery capacity. The higher pressure, which is used for displacing the control valve into the closed position, results from the pressure loss of the flowing hydraulic medium across the control valve, viewed from the inflow side to the outflow side. In a manner of speaking, this is a dynamic pressure due to the motion of the hydraulic medium, i.e., the pressure difference which arises across the control valve. The control valve responds to the direction of flow of the hydraulic medium.

The pressure in the hydraulic-medium feed line increases, corresponding to the triggering of a pressing operation, from ambient pressure (or slightly above same) to the triggering pressure for the pressing operation. Such a triggering pressure may be between 300 and 700 bar, for example. After pressing has been completed, when the return valve has opened, the pressure in the hydraulic-medium feed line through which hydraulic medium flows back into the storage space, depending on the design as described in greater detail below, is for example between 10 and 0.5 bar (positive pressure). In this regard, all intermediate values, in particular in increments of 0.1 bar, are included in the disclosure.

Via a delivery line, the hydraulic-medium pump delivers into a first branch line leading to the control valve, and a second branch line leading to the return valve. When a standard pressing operation is triggered, the return valve is closed, or, for example by lifting an opening detent, is closed during the course of this triggering. Thus, the hydraulic medium is merely present in this branch line, but does not flow within it. However, the hydraulic medium then flows via the control valve and the hydraulic-medium feed line into the cylinder chamber. In addition, a bypass, in a manner of speaking, may be provided directly into the cylinder chamber. The delivery to the return valve accordingly does not occur via a line or not only via the control valve, but, rather, optionally additionally, is effected in parallel thereto. The return valve is hydraulically connected in parallel to the control valve, relative to the delivery of the hydraulic medium.

In this regard, it is also preferably provided that when the return valve is open, hydraulic medium flowing out through the return valve, preferably all of the hydraulic medium, initially flows through the control valve. In this case, when hydraulic medium is flowing out, the return valve is hydraulically connected downstream from the control valve. However, it may also be provided that the hydraulic medium flows only partially through the control valve. The other portion of the hydraulic medium may flow through a line which leads directly from the cylinder to the return valve, this line also preferably having a throttling point. All of the hydraulic medium may also flow through the mentioned separate line from the cylinder chamber to the return valve. However, in this latter case as well, it is provided that this line leading to the return valve is in line connection with the control valve, specifically with the inflow side of the control valve. In this design configuration as well, in the case of the return flow of hydraulic medium, the pressure action in this regard is therefore provided on the inflow side of the control valve.

The control valve may be biased into its open position by means of a spring. In the present case, this biasing is preferably selected to be less than equates to a force acting on the control valve by virtue of a spring action on the return piston. The pressure which is caused in the hydraulic-medium feed line by the spring action on the return piston in the case of the return movement, and which, as stated, may be for example between 0.5 and 5 bar, results in a force which acts on the control valve according to the hydraulically active surface area of the control valve. Regardless of the lower pressure or even negative pressure in the hydraulic-medium storage space, which may possibly have an additional assisting effect, the mentioned force exerted by the spring action on the return piston is greater than is equivalent to the spring force acting on the control valve in the opening direction. A realistic magnitude of the force of this spring which acts on the control valve in the opening direction is, for example, between 0.1 and 1 newton, more preferably between 0.2 and 0.4 newton; all intermediate values, in particular in 1/10 newton increments, are included in the stated ranges.

As an alternative to the above-described design, in which hydraulic medium flows at least partially via the control valve to the return valve in the case of the opening of the return valve, it may be provided that in its open position, the control valve at the same time blocks the hydraulic-medium feed line through which hydraulic medium is otherwise able to flow to the return valve. This blocking may preferably also be provided as a seat valve. The outflow may then be provided via a direct line connection provided, for example, from the hydraulic cylinder to the return valve, as previously described. However, the outflow via the return valve may also be completely interrupted by this. In this case, the return valve immediately goes into its closed position due to the associated pressure drop.

The return valve is set at the highest pressure, i.e., the pressing pressure to be achieved. Due to the (further) pressure drop that results when the control valve opens, the control valve allows an automatic drive of the return valve into the closed position, with simultaneous opening of a (further) outflow path for the hydraulic medium. It is thus possible, in the course of carrying out a pressing operation, to first take up in a desired manner any intermediate position, and then resume the pressing operation. After the pressing operation is carried out, stopping of the movable part, i.e., the return piston as a rule, may be achieved by simply reactivating the pump, and the next pressing operation may be performed starting from this position.

In particular, the control valve is composed of a valve closing body which interacts with a valve seat that is formed fixedly with the housing. In this regard, it is preferably provided that the valve closing body passes through a compensating part for lining up the movement of the valve closing body. Thus, the compensating part moves together with the valve closing body from the closed position into the open position, and vice versa. The compensating part is designed in such a way that the valve closing body is able to move therein, transversely with respect to its prescribed direction of movement from the closed position into the open position, and vice versa. For this purpose, the valve closing body is also preferably accommodated as a whole, with corresponding play, in the hydraulic-medium feed line. This movability of the valve closing body ensures that a reliable closure of the control valve results, even when the valve seat is not precisely aligned with the valve closing body. The valve closing body accordingly has a movability which is sufficient with regard to possible manufacturing tolerances.

The compensating part may be provided in the form of a washer, for example. In addition, the compensating part, for example the washer in particular, is preferably not fitted in a sealing manner in the hydraulic-medium feed line, which further preferably has a cylindrical configuration, at least in this region. Rather, a radial gap, even though very small, which allows a certain flow of hydraulic medium, may also suitably remain here. In any event, in the idle state, such a gap allows pressure compensation via the compensating part. A realistic size for such a gap is approximately 1/100 to 2/100 mm. On the other hand, the movability of the valve closing part, transverse to its direction of motion, with regard to an opening or closing operation, is 2/100 to 10/100 or several hundredths of a millimeter, for example up to ½ mm.

BRIEF DESCRIPTION OF THE DRAWINGS

The invention is described in greater detail below with reference to the appended drawings which however illustrate only exemplary embodiments.

DETAILED DESCRIPTION OF THE ILLUSTRATED EMBODIMENT

Figure 1:
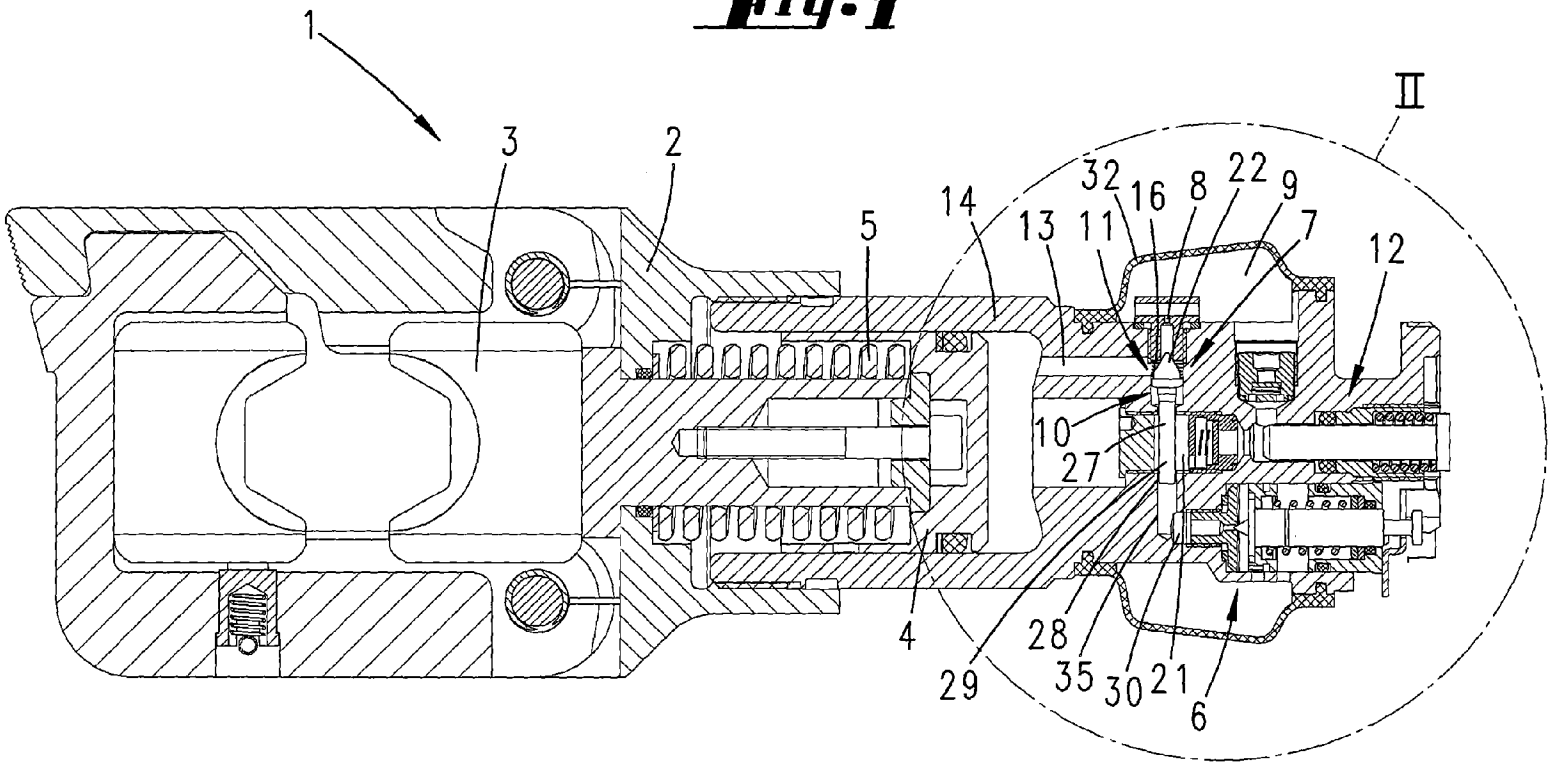
FIG. 1 shows an illustration, in partial cross-section, of a front part of a press unit.

Illustrated and described, initially with reference to FIG. 1, is a hydraulic press unit having a fixed part 2 and a movable part 3. The movable part 3 is moved relative to the fixed part 2, which may also be regarded as the overall housing, by means of a hydraulic piston 4. The hydraulic piston 4 is movable back into its starting position by means of a return spring 5 and is biased by this spring into the starting position when the piston is not in use. The return movement of the hydraulic piston 4 can be actuated during a pressing operation by activation of a return valve 6. In the exemplary embodiment, this return valve 6 is designed and operates as described in EP 0 944 937 B1. The disclosure content of EP 0 944 937 B1 with regard to the design of this return valve and the corresponding mode of operation is hereby incorporated by reference in the disclosure of the present application, including for the purpose of incorporating one or more features known from said EP 0 944 937 B1 in the claims of this application.

In addition, a control valve 7 is provided which influences the closing characteristics of the return valve 6. The return valve 6 preferably no longer stays open until the hydraulic piston 4 has completely returned. Due to the control valve 7, there results, in the open state of this control valve 7, a pressure drop upstream from the return valve 6 which is so great that in this way the return valve 6 closes early, before the hydraulic piston 4 reaches its final return position. A further return motion of the hydraulic piston 4 then occurs only as the result of outflow of hydraulic medium through the outflow opening 8 into the hydraulic-medium storage space 9, which outflow is enabled by the control valve 7 when this control valve 7 is in the open state.

In particular, the control valve 7 has an inflow side 10 and an outflow side 11. The inflow side 10 refers to the fact that the control valve 7 is acted on at this side by the hydraulic medium when hydraulic medium is delivered by the hydraulic-medium pump 12. The hydraulic medium flows via the outflow side 11 through the hydraulic-medium line 13 into the hydraulic cylinder 14, in which the hydraulic piston 4 is accommodated. The hydraulic pump 12 may be a reciprocating pump, as illustrated. However, it may also be a screw pump, for example. The latter has the advantage that pumping is performed at a continuous pressure. When hydraulic medium is delivered through the open control valve 7, which is concurrently, but also practically immediately, displaced into the closed position, throttling action results in a pressure drop of 1 bar, for example, which causes the mentioned displacement into the closed position.

Figure 2:
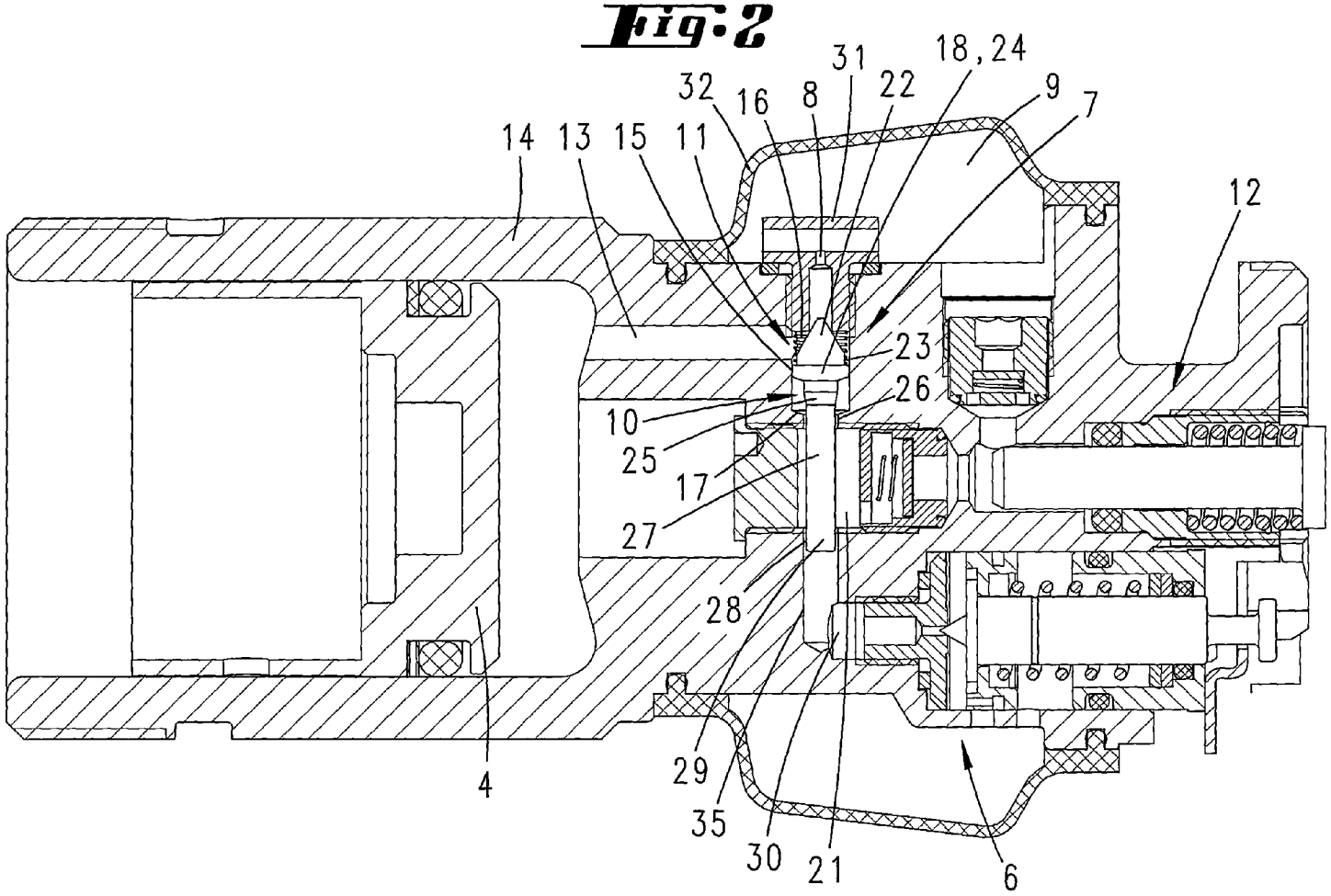
FIG. 2 shows an enlargement of region 2-2 in FIG. 1, with the control valve and return valve closed.

The path of the returning hydraulic medium, for which purpose reference is also made to FIG. 2 in particular, is at the beginning, upon opening of the return valve 6, determined by the control valve 7, which allows hydraulic medium to flow past as the result of a flow path gap 15 which is left open around the periphery of the control valve 7. Since this flow path gap 15 is relatively small, this clearly results in a throttling, which causes a pressure drop across the control valve 7. On the inflow side 10, which in this state is actually an outflow side, a lower pressure accordingly then prevails than on the outflow side 11. Furthermore, a certain back pressure may in addition be developed on the outflow side 11. As a result of this pressure difference, and assisted by a compression spring 16 which biases the control valve 7 into the open position, the control valve 7 is displaced very rapidly into the open position according to FIG. 3.

For a general design, however, the compression spring 16 is actually not needed for displacing the control valve 7 into the open position. However, due to the flow through the outflow opening 8 that arises, a suction effect may develop on the open control valve 7 which is counteracted by the compression spring 16.

Figure 3:
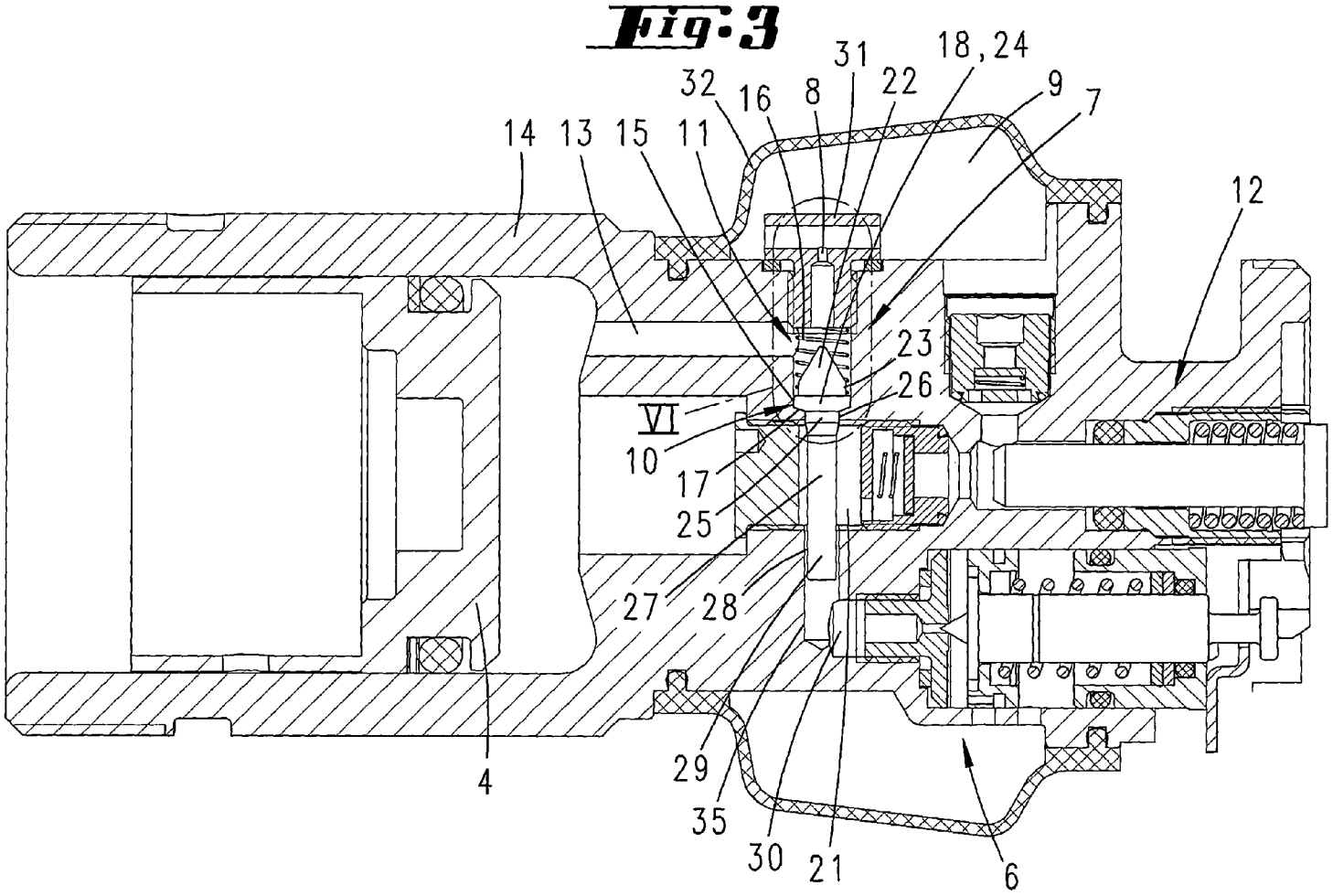
FIG. 3 shows an illustration corresponding to FIG. 2, with the control valve open.

The open position according to FIG. 3 may on the one hand be provided in such a way that a tight or practically tight valve seat 17 results. An opening-seat portion 18 of the control valve 7 interacts in a sealing manner with the housing wall 36, which in this region has a constriction which forms the valve seat 17. As a result, when the control valve 7 is formed as a shuttle valve, wherein in one position (closed position) the control valve 7 closes the outflow opening 8, and in the other position (open position with respect to the closed position 8) the control valve 7 closes the flow to the return valve 6, there results a closing of the return valve 6 also for the case where the return valve 6 is intended to have sufficiently great hysteresis for it to otherwise remain in the open position during the entire return travel of the hydraulic piston 4. Thus, even after the return valve 6 opens, there is sufficient time to switch off the hydraulic pump 12 so that the control valve 7 is not immediately closed again as soon as the return valve 6 closes and the pump 12 would continue to deliver. However, the design may also be provided in such a way that even in the open state of the control valve 7 according to FIG. 3, there is still flow of hydraulic medium to the return valve 6. As the hydraulic piston 4 travels farther back, the spring 5 relaxes, causing less pressure to be exerted on the hydraulic medium. Accordingly, the return valve 6 is then also able to move into a closed position when the pressure falls below a required critical pressure that is necessary for maintaining the open state of the return valve 6. The closed position of the return valve 6 is thus also reached before the hydraulic piston 4 has completely traveled back to its end position. However, the adjustment may also be made in such a way that, for example to achieve the quickest possible return of the hydraulic piston 4, the control valve 7, as well as the return valve 6, remains in the open position until the end position is reached. In the exemplary embodiment illustrated, the adjustment is provided in such a way that the return valve 6 immediately moves into its closed position when the control valve 7 opens.

The outflow of the hydraulic medium is then effected only through the outflow opening 8, which is formed in the valve seat of the control valve 7.

In addition to the path of the hydraulic medium via the control valve 7 when a pressing operation is actuated, a delivery path 19 may be provided (see FIGS. 4, 5), which path is formed in the bypass for this purpose. This delivery path 19 is preferably formed as a throttling point. According to FIG. 5, the delivery path 19 may also be closed by a non-return valve 20, so that hydraulic medium flows through the delivery path 19 only when hydraulic medium is being delivered by the pump 12.

Figure 4:
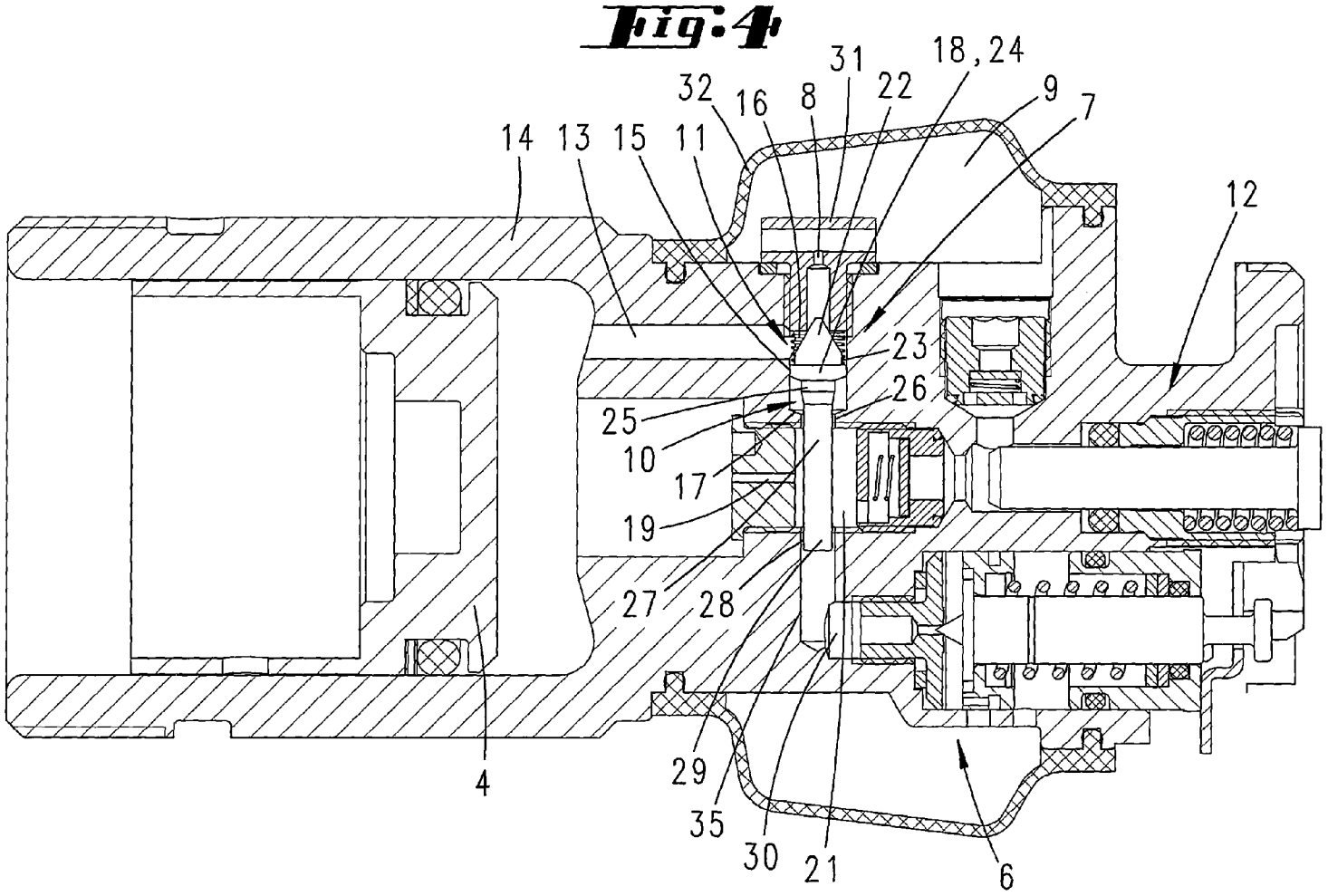
FIG. 4 shows an illustration corresponding to FIG. 2, with an additional throttle opening.
Figure 5:
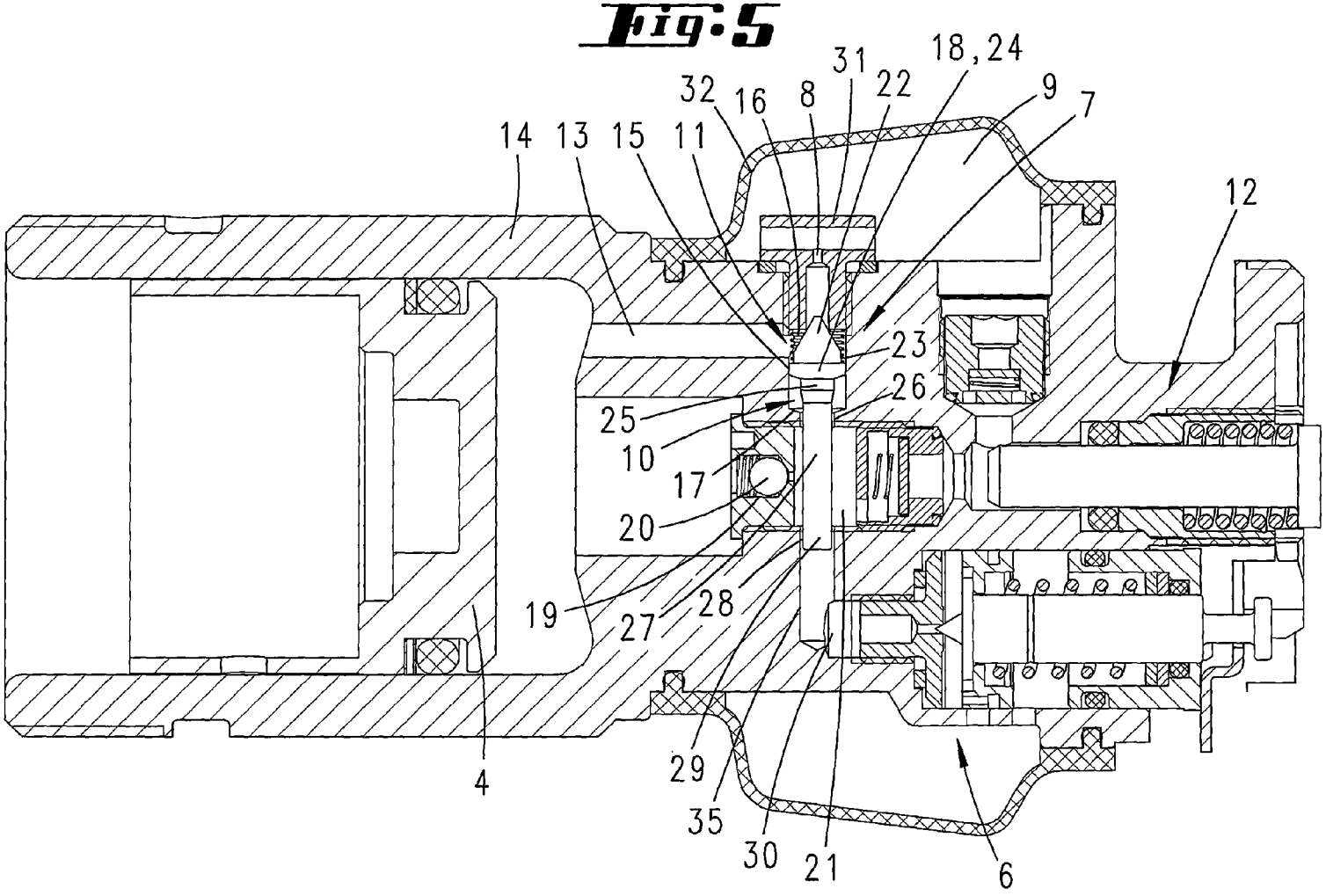
FIG. 5 shows an illustration corresponding to FIG. 4, with a modified throttle opening.

In the configuration according to FIG. 4, hydraulic medium flows through the delivery path 19 into the chamber 21 also after the triggering of the return valve 6, and from there, when the return valve 6 is open, flows via the return valve 6 into the hydraulic-medium storage space 9.

The embodiment described here is particularly advantageous in several respects.

When the operation of the pump 12, which is for example driven by an electric motor, is triggered by appropriate activation of a switch after initiation of a pressing operation, the control valve 7 is immediately displaced into the closed position. The restoring spring 16, which acts on the control valve 7 and brings it into the open position, is for this purpose designed in such a way that, even in the event of the pump 12 stopping immediately after initiating the pressing operation, for example because the switch is no longer pressed, the closing pressure acting on the control valve 7 is sufficient to hold the control valve 7 in the closed position. In that case, the hydraulic piston 4 does not return. By once again activating the trigger switch, the pressing operation may be resumed with the hydraulic piston 4 being in the same position as that which it occupied when the pumping operation was interrupted. If a return of the hydraulic piston 4 is nevertheless desired, this may be additionally activated via the manual switch 21 which acts on the return valve 6 (see FIG. 4, for example).

On the other hand, the control valve 7 is designed in such a way that, in the case that the return valve 6 is triggered, the described pressure drop in each case displaces the control valve 7 into the open position. The control valve 7 then also remains in this open position due to the biasing by the spring 16.

However, during a return movement of the hydraulic piston 4 then effected in the foregoing manner, the pump 12 may be reactivated at any time by actuating a switch. The control valve 7 immediately moves into the closed position, causing the hydraulic piston 4 to stop at the travel position which it has then reached in the hydraulic cylinder 14. The next pressing operation may then be carried out starting from this position, without the need for a complete return movement.

In further detail, the control valve 7 is clearly formed with a front conical seat region 22, which merges into an enlarged flange region 24 via a cylindrical portion 23. A throttle region 25 adjoins this flange region 24 at the rear. When the control valve 7 is displaced into the open position in the stated manner, this action occurs very rapidly, practically immediately. As a result of the throttle region 25 plunging by the above action into the through opening 26, which is only slightly larger, a desired deceleration occurs, and the flange region 24 engages gently against the wall of the housing 36.

Adjacent thereto, an elongated shank 27 is formed, which has an extension portion 29 that reaches as far as and into an inlet hole 28 of the return valve 6. The inlet hole 28 proceeds in a continuation 30 that runs at right angles to the inlet hole 28 and in which the return valve 6 is situated. The shank 27 passes through the chamber 21, which is reached initially by hydraulic medium delivered by the pump 12. This chamber 21 clearly branches into an inlet to the control valve 7 and an inlet to the return valve 6, and also into the bypass line 19, if this is provided.

An impact wall 31 which is associated with the outflow opening 8 is provided in the storage space. Even for a small diameter of the outflow opening 8, a thin, intense jet of hydraulic medium generated by this opening cannot result, for example, in damage to the opposite wall 32 of the storage space 9. In particular, the wall 32 is preferably formed by a flexible rubber material. The impact wall 31 is formed in particular by a T tube, one portion of the T tube being formed as a screw-in portion, the end of which forms the seat for the control valve 7, and the other portion of the T tube forming the mentioned impact wall 31.

Figure 6:
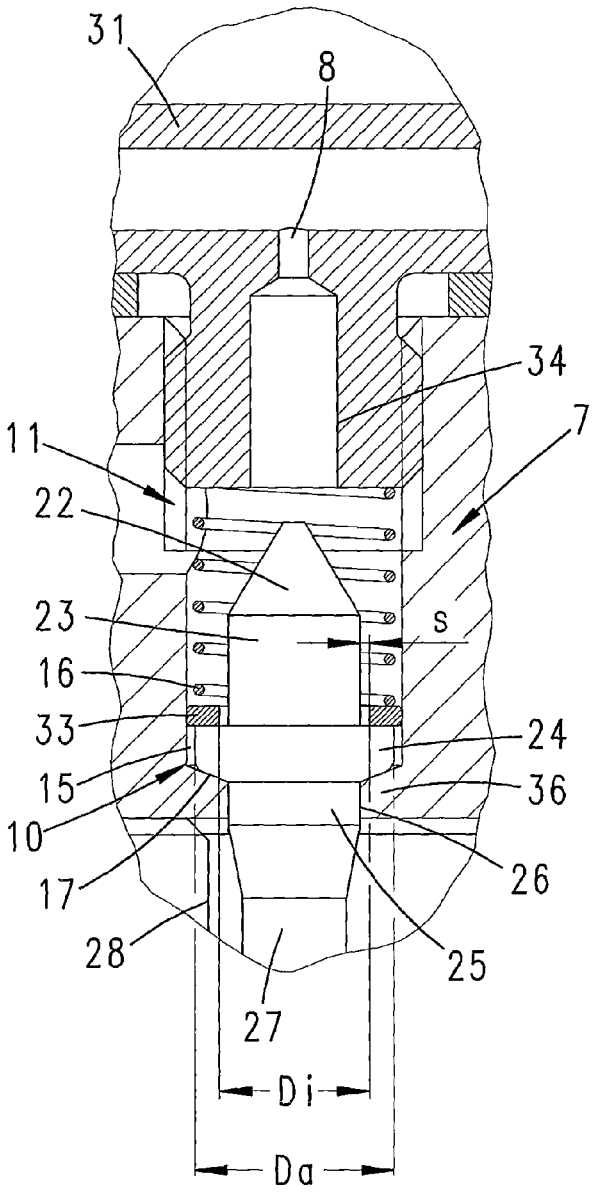
FIG. 6 shows an enlarged illustration of the control valve region VI-VI in FIG. 3, together with a compensating part.

With reference to FIG. 6, it is apparent that the valve body of the control valve 7 that has the seat region 22, the cylindrical portion 23, and the flange region 24, passes through a compensating part 33. The compensating part 33 is designed as an annular body having an inner diameter Di which is smaller than an outer diameter Da of the flange region 24. The valve closing body, i.e., the cylindrical portion 23 in the exemplary embodiment, passes through the compensating part 33 on the seat region side of the flange region 24. The inner diameter Di of the compensating part 33 leaves a gap s with respect to the mentioned cylindrical portion 23. This gap s allows the valve closing body to move transversely with respect to its longitudinal extent. This automatically results in a certain transverse displacement when, for example, the hole 34 which forms the counter-valve seat of the valve seat part 34, which seat is in the present case formed by the T tube, is not aligned with a longitudinal center axis of the valve body.

As further to be inferred from FIG. 2, for example, and the above description, a flow path leads from the hydraulic-medium pump 12, through the chamber 21 and the line portion 35 branching off therefrom, directly to the return valve 6. From a hydraulic standpoint, i.e., with regard to the at least theoretical path traversed by the hydraulic medium during flow, the hydraulic-medium feed in the form of the hydraulic-medium pump 12 and the directly adjoining line path, as well as the return valve 6, are hydraulically situated on the same side, namely, the inflow side of the control valve 7.

All features disclosed are, in themselves, pertinent to the invention. The disclosure content of the associated/accompanying priority documents is also hereby incorporated by reference in the disclosure of this application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE NUMERALS

1 Hydraulic press unit
2 Fixed part
3 Movable part
4 Hydraulic piston
5 Return spring, spring
6 Return valve
7 Control valve
8 Outflow opening/hydraulic-medium outlet
9 (Hydraulic-medium) storage space
10 Inflow side
11 Outflow side
12 Hydraulic-medium pump
13 Hydraulic-medium line
14 Hydraulic cylinder
15 Flow path gap
16 Compression spring/restoring spring
17 Valve seat
18 Opening seat portion
19 Delivery path/bypass line
20 Check valve/non-return valve
21 Chamber/manual switch
22 Seat region
23 Cylindrical portion
24 Flange region
25 Throttle region
26 Through opening
27 Shank
28 Inlet hole
29 Extension portion
30 Continuation
31 Impact wall
32 Wall of storage space 9
33 Compensating part
34 Hole/seat part
35 Hole portion/line portion
36 Housing wall

The invention claimed is:

1. A hydraulic press unit comprising:
a fixed part;
a movable part movable relative to said fixed part;
a hydraulic piston causing said movable part to move relative to said fixed part;
a return spring for moving said movable part to a starting position by a return movement;
a return valve capable of moving between an open state and a closed state, said return movement being actuatable as a function of a predetermined applied pressure by activation of said return valve;
a control valve capable of moving between an open state and a closed state, said control valve which, in addition to the return valve, opens a hydraulic-medium outlet when in its open state, said control valve having a hydraulic-medium inflow side and a hydraulic-medium outflow side;
wherein when the return valve opens, the control valve is acted on by the pressure of the returning hydraulic medium on the inflow and outflow sides, the pressure being lower on the inflow side due to throttling.

2. A hydraulic press unit according to claim 1, further including a hydraulic-medium pump, a first hydraulic-medium flow path between said hydraulic-medium pump and said control valve, and a second hydraulic-medium flow path between said hydraulic-medium pump and said return valve.

3. A hydraulic press unit according to claim 1, wherein said control valve is formed as a seat valve.

4. A hydraulic press unit according to claim 1, wherein said control valve is provided in a feed line leading to a hydraulic cylinder which accommodates said hydraulic piston.

5. A hydraulic press unit according to claim 4, further including a hydraulic-medium storage space, and wherein said control valve when in said closed state is acted on by a differential force that is formed by the pressure in said hydraulic-medium storage space and the pressure in the feed line.

6. A hydraulic press unit according to claim 4, wherein said feed line leads from the hydraulic-medium pump to the hydraulic cylinder and has a direct connection to the return valve and to the control valve.

7. A hydraulic press unit according to claim 1, wherein hydraulic medium flowing back through the return valve first flows through the control valve.

8. A hydraulic press unit according to claim 1, wherein a biasing force acting on said control valve and urging said control valve into the open state is less than which equates to a force acting on the control valve by virtue of a spring action on the hydraulic piston.

9. A hydraulic press unit according to claim 1, wherein the control valve in the open state blocks a return flow of hydraulic medium to the return valve.

10. A hydraulic press unit according to claim 1, wherein the control valve has a closing body which passes through a compensating part for lining up a movement of a valve closing body.

* * * * *